United States Patent [19]

Zimmerlund

[11] Patent Number: 4,858,779

[45] Date of Patent: Aug. 22, 1989

[54] CONTAINER

[75] Inventor: Hans Zimmerlund, Skellefteå, Sweden

[73] Assignee: Scandinavian Transshpment AB, Skellefteå, Sweden

[21] Appl. No.: 283,017

[22] Filed: Dec. 9, 1988

Related U.S. Application Data

[63] Continuation of Ser. No. 865,195, May 14, 1986, abandoned.

[30] Foreign Application Priority Data

Sep. 14, 1984 [SE] Sweden ..... 8404627

[51] Int. Cl.[4] ..... B65D 19/00

[52] U.S. Cl. ..... 220/6; 220/1.5

[58] Field of Search ..... 220/1.5, 6

[56] References Cited

U.S. PATENT DOCUMENTS

| | | | |
|---|---|---|---|
| 3,382,998 | 5/1968 | Turpen | 220/1.5 |
| 3,570,698 | 3/1971 | Dougherty | 220/7 X |
| 3,684,122 | 8/1972 | Bonomi | 220/7 X |
| 4,240,359 | 12/1980 | Howe | 220/7 X |
| 4,314,686 | 2/1982 | März | 220/6 X |

FOREIGN PATENT DOCUMENTS 29113 8/1971 Australia .

*Primary Examiner*—Steven M. Pollard

*Attorney, Agent, or Firm*—Cushman, Darby & Cushman

[57] ABSTRACT

This invention relates to a collapsible container comprising a bottom unit (1:1'), four angle posts (7:7'), two longitudinal side walls, two end walls (11:11') and an upper unit (12:12') supported by the end walls (11:11').

The reason for the container being made collapsible is to make it possible to place a number of folded-up containers in an unfolded container of the same kind at so-called return freight.

What characterizes the container of the invention is that the side doors (8:8') forming the side alls are collapsible to packages, which are pivotable relative to the angle posts (7:7'). Moreover, the angle posts (7:7') with intermediate end wall (11:11') are pivotable relative to the bottom unit, the folded-up container having such dimensions that there is room for it in an unfolded container of the same type.

6 Claims, 8 Drawing Sheets

CONTAINER

This is a continuation of application Ser. No. 865,195, filed May 14, 1986 which was abandoned upon the filing hereof.

This invention relates to a collapsible container comprising a bottom unit, four angle posts, two longitudinal side walls, two end walls and an upper unit supported by the end walls.

Containers are used at conveyance of goods both on land and sea and in the air to a very large extent. However, it is a great problem that one must relatively often send containers empty in the one direction. This is extremely unfavourable from an economical point of view as a container takes up a great load volume no matter whether it is filled with goods or not.

It is the object of this invention to provide a collapsible container, the outer dimensions of which are reduced after folding it up so that a number of folded containers can be placed in an unfolded container of the same kind. If, for example, four folded containers can be placed in one unfolded container this will mean that at return freight of empty containers only a fifth of the load volume is used that should have been necessary to use if these containers had been transported in a normally unfolded state.

This object of the invention is realized by means of a container which has been given the characteristic features defined in the following claims.

An illustrative example of the invention will be described below with reference to the enclosed drawings, where:

Figure 1:
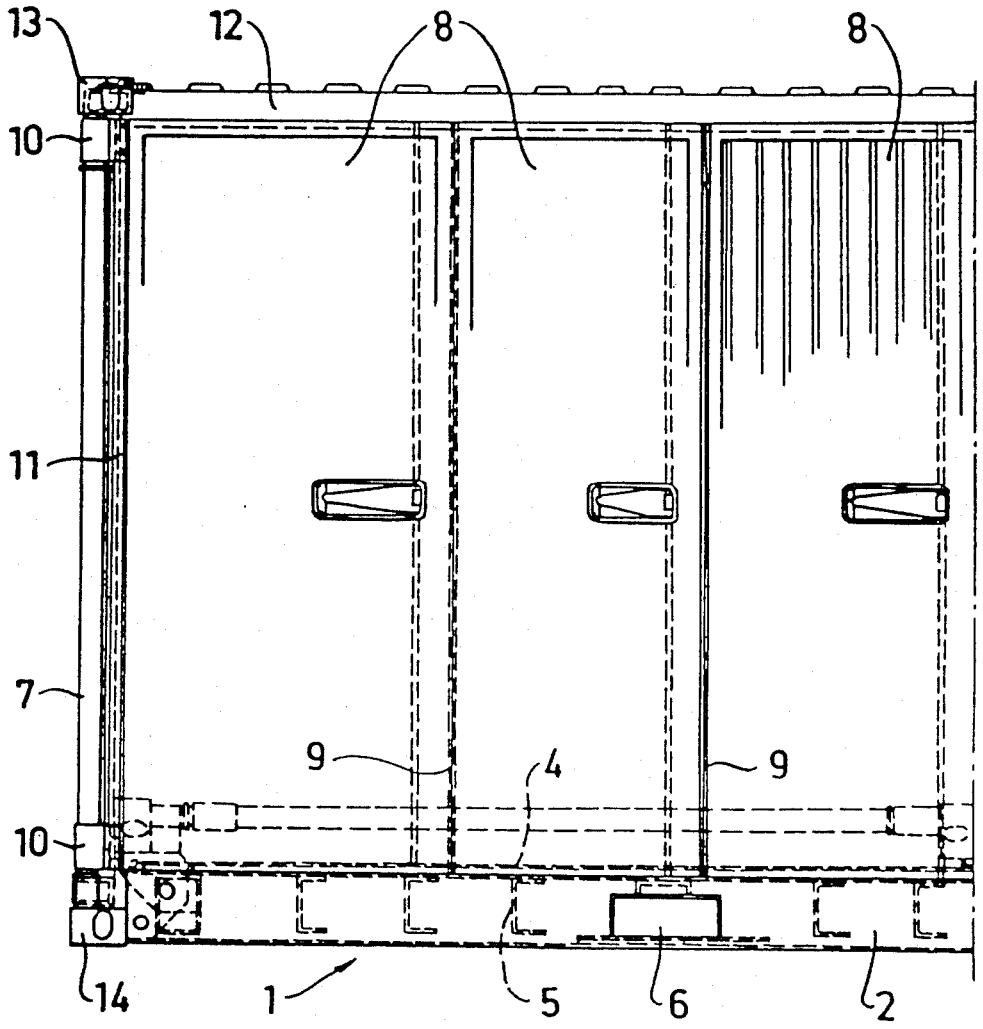
FIG. 1 is a lateral view of half a container according to the invention.
Figure 2:
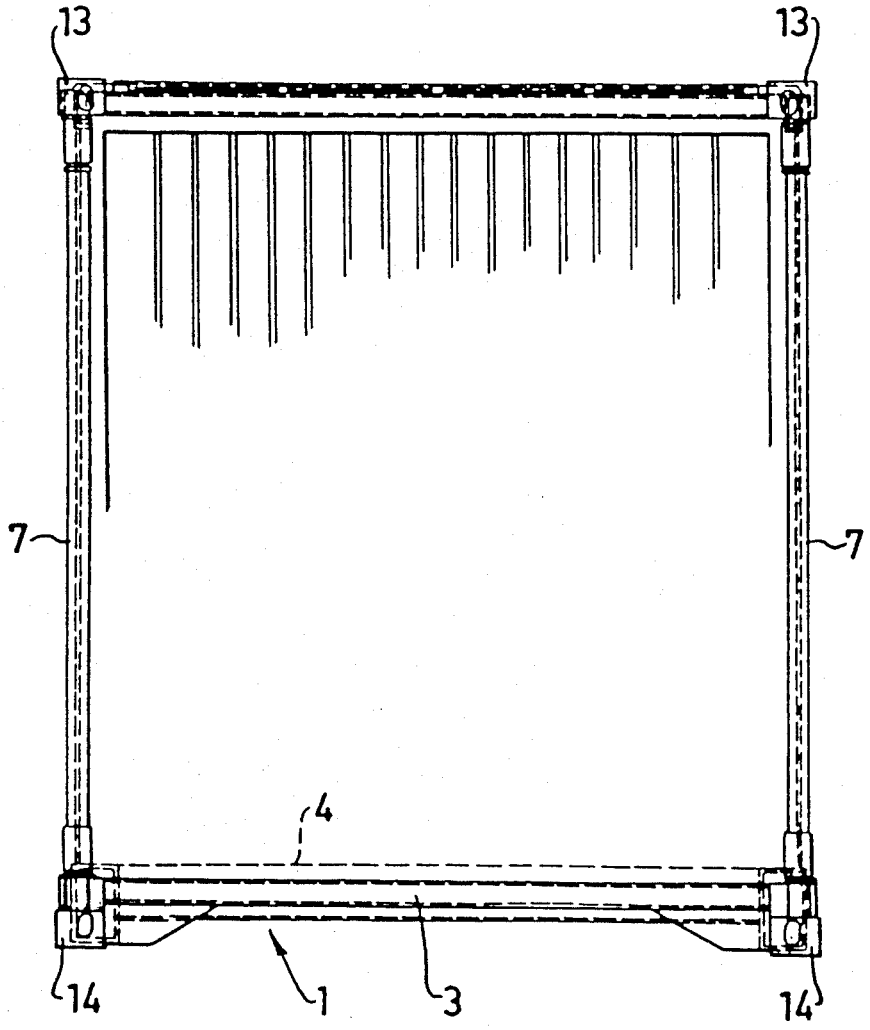
FIG. 2 is an end view of the container according to FIG. 1.

The container shown in FIGS. 1 and 2 comprises a bottom frame 1 which in turn comprises box girders 2 and 3. On the bottom frame 1 a bottom plate 4 is arranged which is supported by C-profiles 5 extending between the box girders 2 of the bottom frame 1. Recesses 6 for the lifting forks of a fork-lift truck are also arranged in said bottom frame.

In the corners of the bottom frame 1 posts 7 are arranged which are articulatedly attached to the bottom frame 1. Said articulated attachment will be described more in detail below.

The longitudinal side walls of the container are formed by a number of side doors 8, six for each wall in the illustrative example shown, which are interconnected in groups of three by means of hinges 9, i.e. they are formed as folding doors. The hinges are made and placed so that three doors can be folded to one package, the door leaves bearing upon each other. Thus, the doors shown in FIG. 1 can be folded to a package of doors.

The left door in FIG. 1 is pivotally suspended on the post 7 via sleeves 10.

At the short sides of the container stationary end walls 11 are arranged, which extend between two adjacent angle posts 7 and are connected to these.

The upper limiting surface of the container consists in the illustrative example shown of a roof cassette 12, which is supported by the stationary end walls 11 and is sealed against these. The roof cassette 12 is blocked against upward direction by means of suitable locking means, which are not shown more in detail.

The container described above can be given different external standard measures. As to the internal spaces in the container these are extraordinarily good in comparison with an ordinary not collapsible container of the same outer measures considering the special properties shown by the container according to the invention.

When folding the container described above it is preferably proceeded in the following way. The side doors 8 are folded three by three to a package after which these packages are turned around the angle posts 7 until contact with the end walls 11. By folding away the side walls 8 the underside of the roof cassette is now accessible, which means that the roof cassette 12 is lifted after its locking means have been transferred to an inactive position. The roof cassette can preferably be lifted off by means of a fork-lift truck.

The next moment of the folding procedure consists of folding the angle posts 7 with intermediate end wall and folded side doors located at the same end as one unit inwards towards the bottom plane of the container until the upper ends 13 of the angle posts 7 bear in principle on the bottom plane 4.

Figure 5:
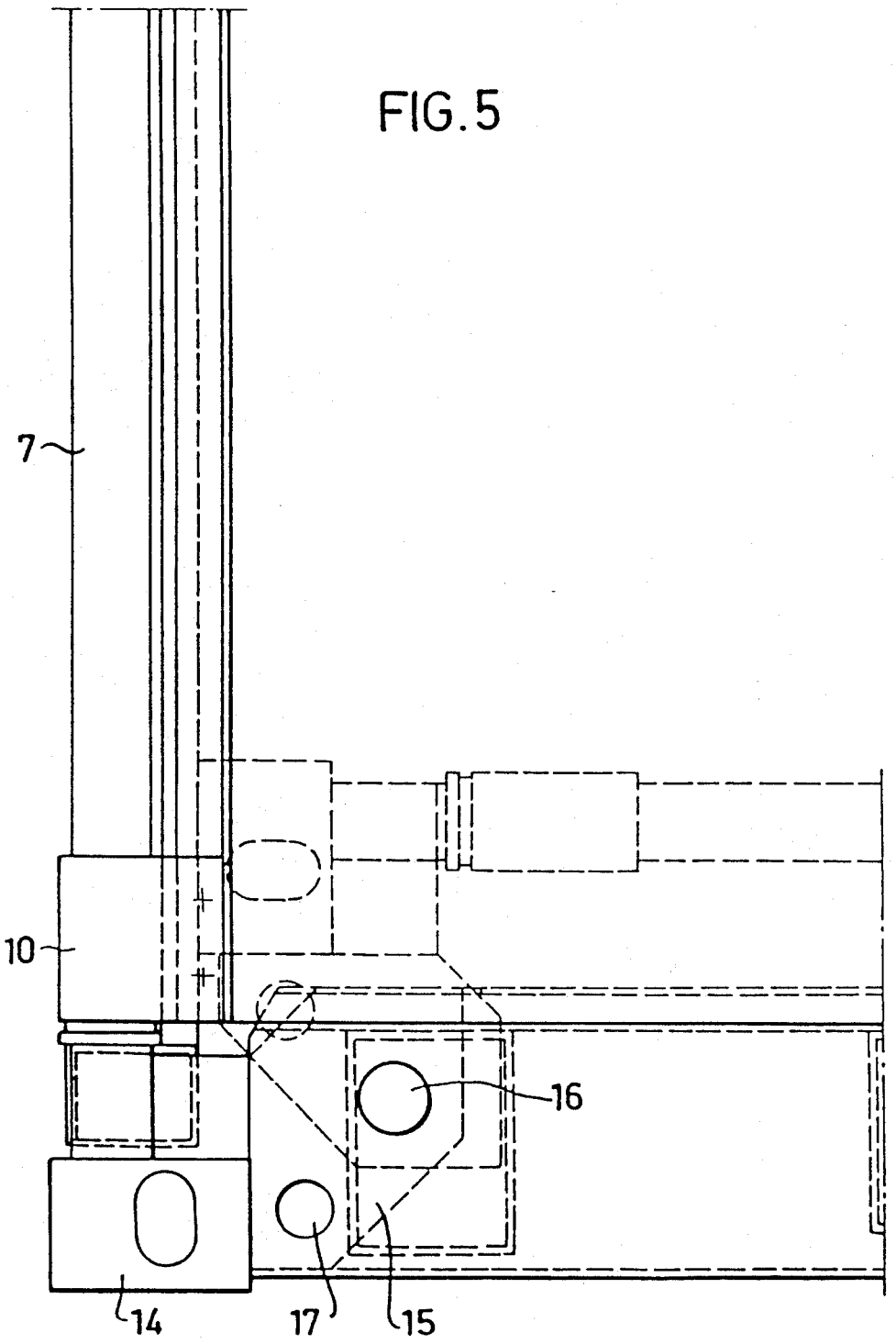
FIG. 5 shows a detail of the attachment of the angle post to a container according to the invention.

In this connection the pivotable attachment of the angle posts to the bottom frame 1 will be described with reference to FIG. 5. As is apparent from FIG. 5 the angle post 7 has a base portion 14 which in unfolded position of the angle posts 7 bears on the support on which the container is resting. At the base portion 14 an attaching plate 15 is adapted which is pivotally attached to the bottom frame 1 via the joint 16. In order to ensure that the post 7 is retained in its upright position a locking pin is inserted into the opening 17, said locking pin being anchored to the bottom frame 1 in a suitable manner.

When the angle posts 7 are to be turned from their vertical positions to a put down position according to FIG. 1 the posts 7 are made free by removing the locking pins in the openings 17. After this the angle posts 7 are folded to the dashed position in FIG. 1, the base portion 14 of the posts 7 being turned upwards-inwards around the joint 16 to the dashed position in FIG. 1. As is realized when looking for example at FIGS. 1 and 5 the outermost contour of the base portion 14 will in folded position be located inside the end wall 11 when this is in a raised position.

In FIG. 1 only half the long side of a container according to the invention is shown which means that the angle post not shown will be with its upper end in immediate connection to the upper end 13 of the folded angle post shown in FIG. 1.

Figure 3:
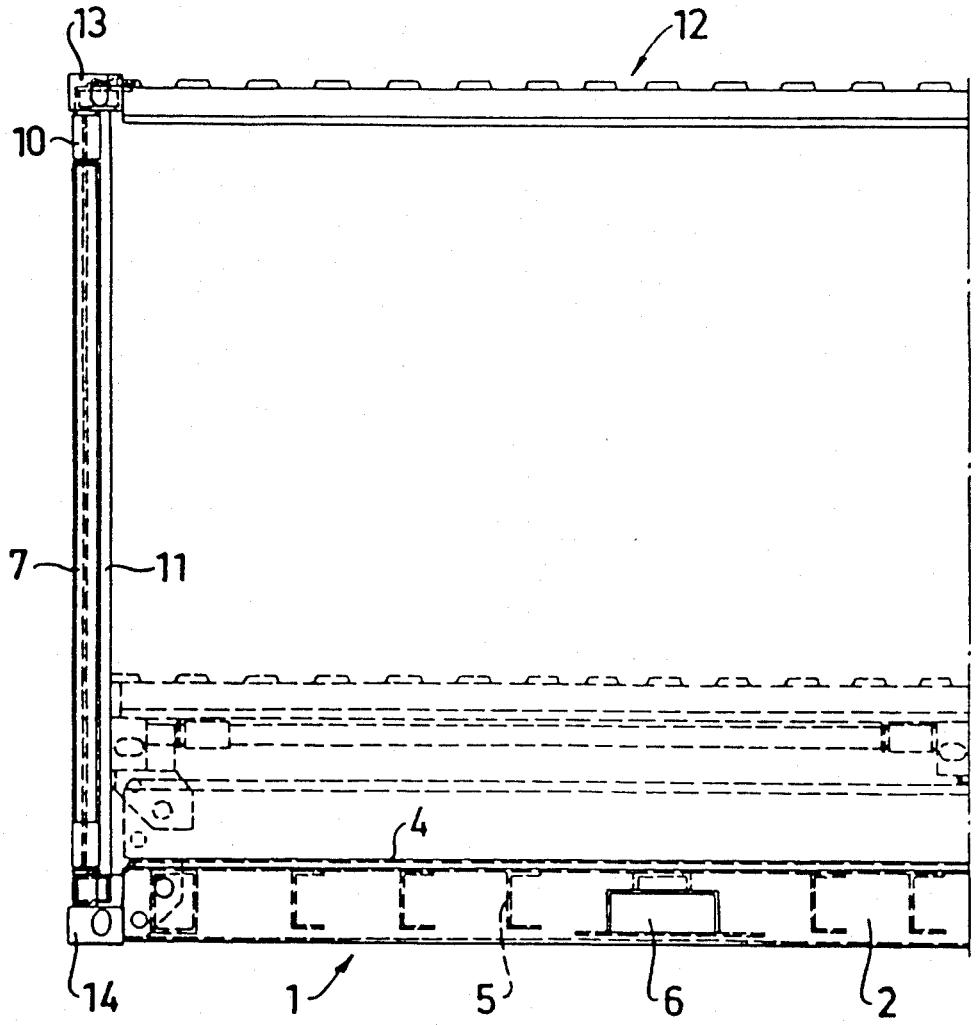
FIG. 3 is a lateral view of half a container according to the invention where the side doors have been removed, and it has also been indicated with broken lines how a folded container will get room in the unfolded container.

By the attachment of the angle posts 7 described above and the compact package formed by the side doors 8 in folded position a container, the angle posts of which have been folded with associated end walls and side door package to the dashed position according to FIG. 1, will have room in a container of the same kind, the end walls and angle posts of which are in an unfolded position, see FIG. 3.

Figure 4:
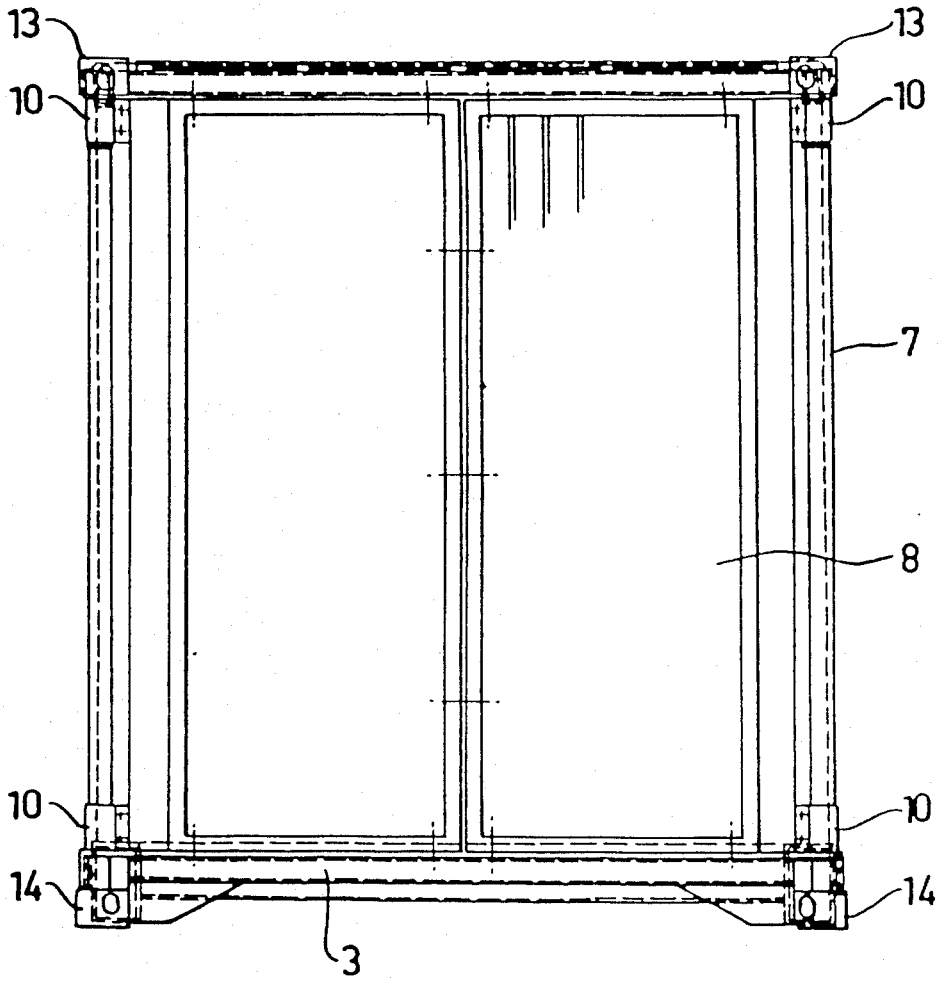
FIG. 4 shows an end view of the container according to FIG. 3.

Before a folded container can be inserted into an unfolded container of the same kind, the side doors 8 of at least one long side of the container must be removed which is effected in the way described above in that they are folded to one package of three, after which said package is turned around the posts 7 to make contact with the end walls 11, see FIG. 4.

Figure 6:
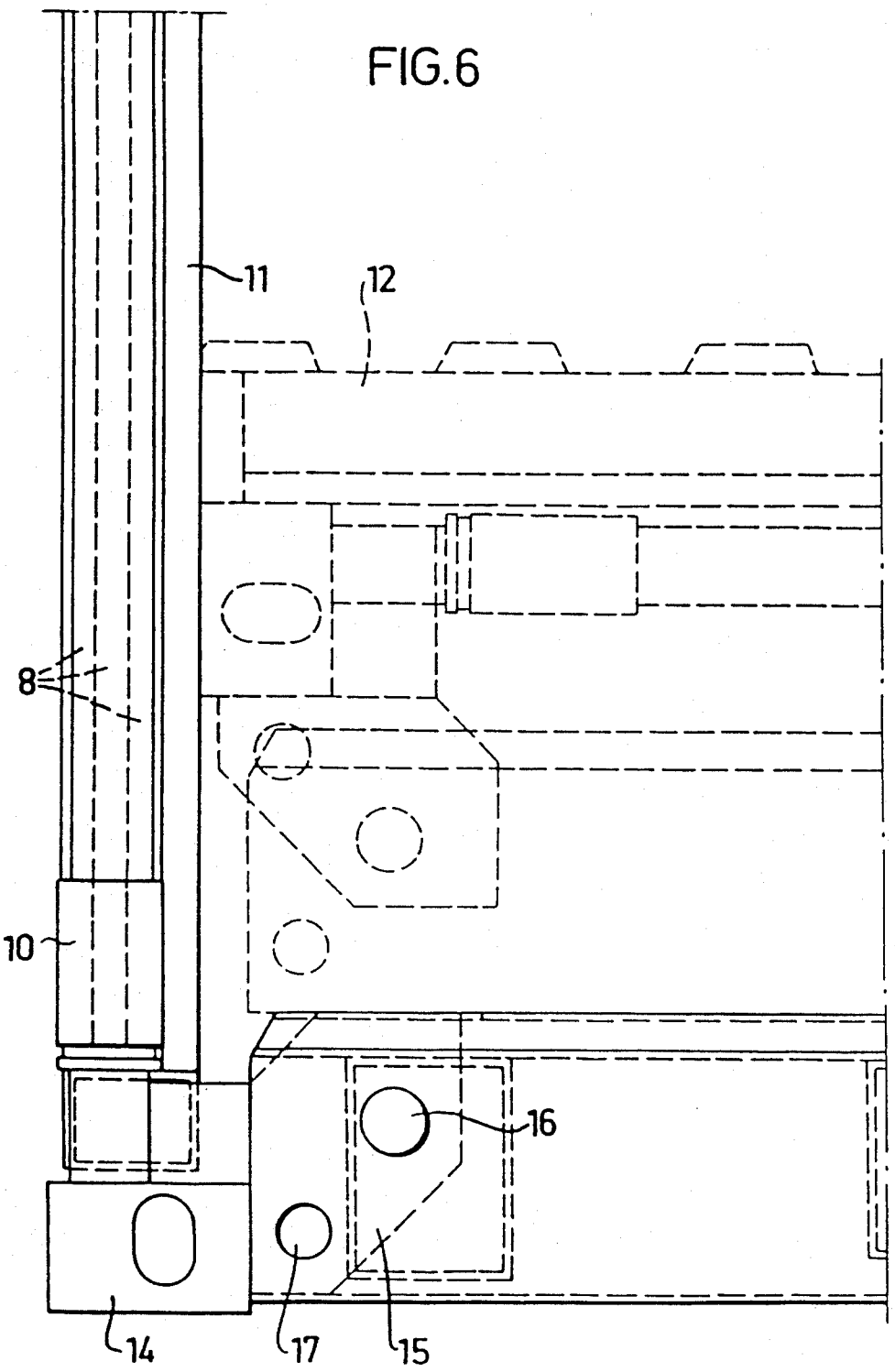
FIG. 6 shows a detail of the attachment of the angle post as well, the location of a folded container within the unfolded container also being shown with broken lines.

When the container according to the invention is in folded position and is located within another unfolded container of the same kind the roof cassette 12 is placed uppermost in the package formed by the folded container, see FIGS. 3 and 6. The roof cassette 12 can be placed on top of the folded posts, preferably before the whole package is lifted into the unfolded container. When lifting the container package into an unfolded container of the same kind the lifting forks of a fork-lift truck are preferably inserted into the recesses 6 of the folded container.

As indicated in FIG. 3 the unfolded container is vertically divided into four sections, which each hold a folded container, and therefore four folded containers can be transported in one unfolded container of the same kind.

Thus, the folding possibilities of the container according to the invention bring an extraordinary saving of volume at transport of empty containers, said saving of volume being of an extraordinarily great economical value.

Figure 7:
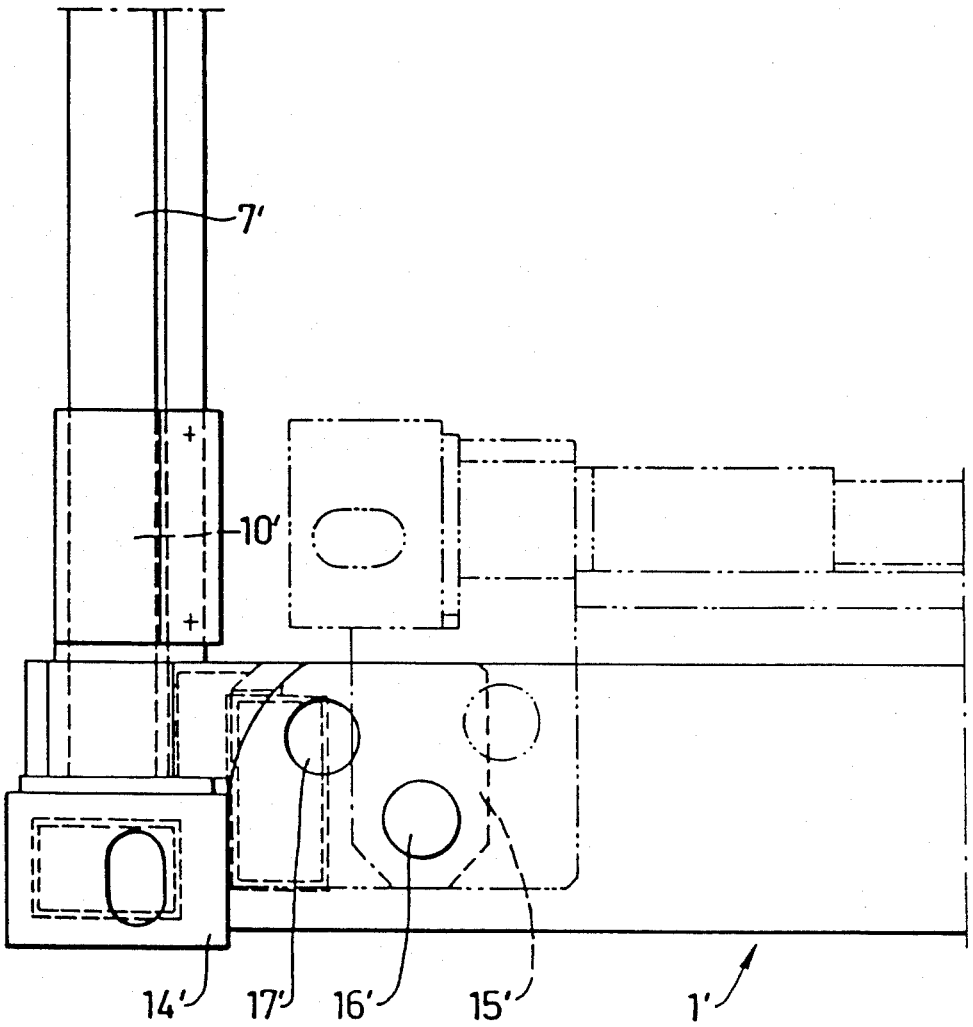
FIG. 7 shows an alternative embodiment of the attachment of an angle post to a container according to the invention.
Figure 8:
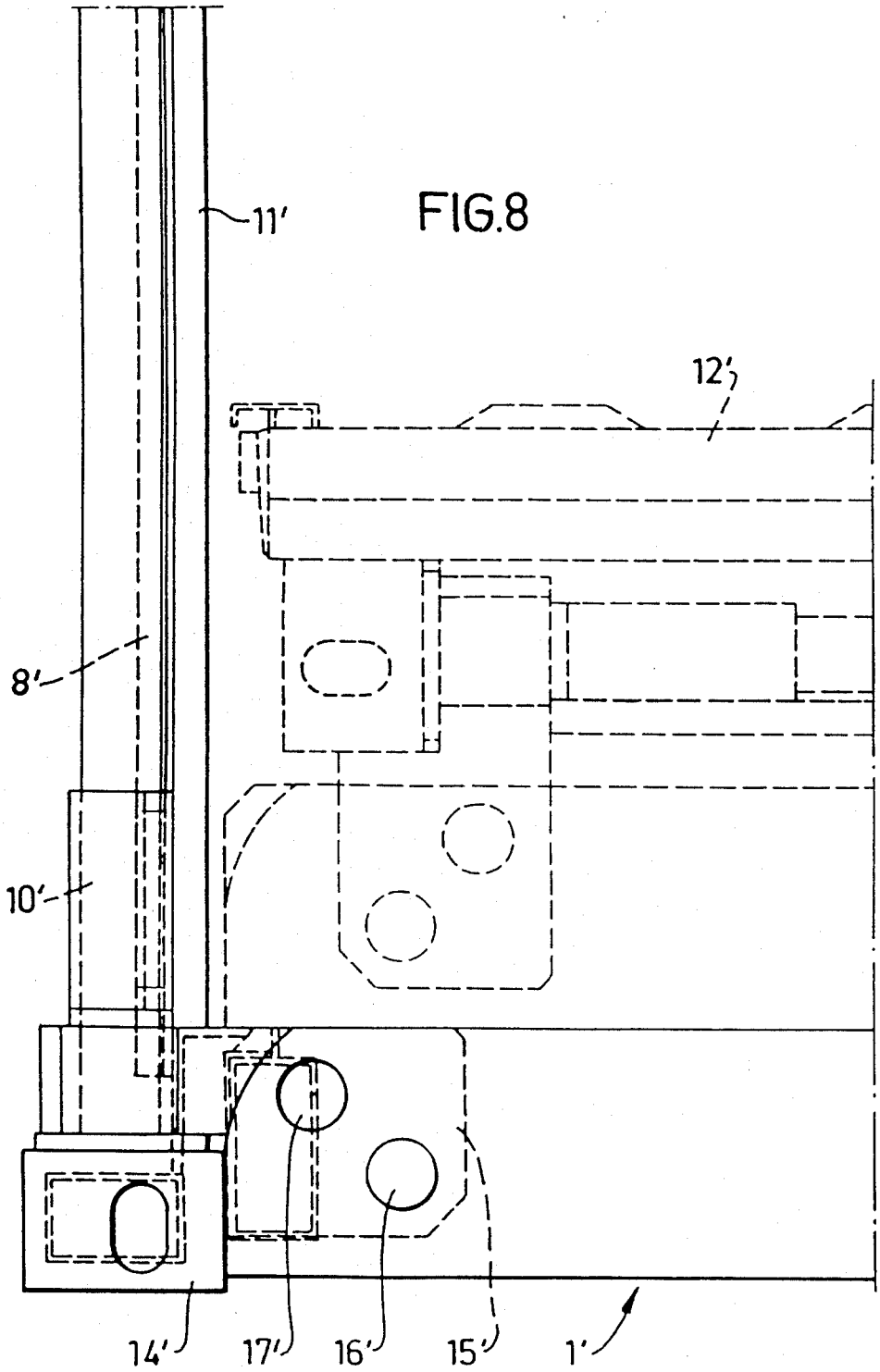
FIG. 8 shows the same detail as FIG. 7, the location of a folded container within the unfolded container also being shown with broken lines.

The embodiment shown in FIGS. 7 and 8 differs from that described above in respect of the attachment of the angle posts 7' to the attaching members 15'.

As is apparent from FIGS. 7 and 8 the joint 16' is located more closely to the support on which the container is resting than in the illustrative example described above. Moreover, the position of the opening 17' holding the locking pin has been changed, the opening being displaced upwards as seen in the position of use of the container.

Said constructive change has resulted in that the base portions 14' of the angle posts 7', when the latter are being folded, are displaced further towards the centre of the container, which is realized immediately in a comparative geometrical consideration of the two embodiments. This means that the linear measure of the container is somewhat further reduced as compared with the illustrative example described above which is advantageous as a greater play is obtained when a folded container is to be pushed in between the end walls of an unfolded container.

A more advanced container construction which comprises means for automatical folding of the container from its unfolded to its folded position is also possible within the scope of the invention. Means built into the container are then arranged which lift the roof cassette 12 upwards so that the angle posts 7 are released with their wall package for folding. Said lifting means can e.g. consist of pressure medium cylinders. Moreover, there should be some mechanical coupling between the roof cassette and the angle posts, e.g. in the form of slewing brackets so that when the angle posts with their respective wall package are folded downwards the roof cassette 12 will follow downwards and place itself on top of the angle posts 7 when these are completely turned down.

Which degree of automatization is to be imparted to the folding and unfolding procedures can of course be varied all according to different users' wishes.

In view of labour protection it can also be necessary to balance the end walls, e.g. by the arrangement of holding-on springs so that the damage which can be caused by an end wall falling down by mistake upon an operator is minimized.

The illustrative example described above refers to a so-called raised container. However, the principle of the invention is also applicable to a container of a normal height.

The invention is by no means limited in other respects to the illustrative example described above but can be freely varied within the scope of the following claims.

I claim:

1. A collapsible container comprising:

a bottom unit defining four corners, two longitudinal edges and two transverse end edges;

an angle post at each of said four corners, each having a base portion, each of said base portions having an associated joint which connects the base portion to said bottom unit, each of said posts being foldable by its joint along one of said longitudinal edges, each of said joints being arranged inwardly relative to its post along said longitudinal direction;

two end walls, each extending transversely along one of said end edges and connected to two of said posts;

two longitudinal side walls, each including a plurality of side doors, said side doors of each side wall being arranged beside each other and being pivotally connected to at least one adjacent side door, wherein, for each side wall, the side door adjacent to an angle post is pivotally connected thereto, the dimensions of the respective side doors and the pivot arragements being such that the respective side walls are foldable against each other to form a package having a maximum width not greater than one half the distance between the angle posts of the respective end wall, and such that the package of side doors is pivotable into abutment relationship with the respective end wall;

an upper unit being supported by said end walls;

said container being collapsible by folding said angle posts along said longitudinal edges and against said bottom unit, said base portions moving upwardly and inwardly with respect to their positions prior to the folding of said angle posts, and the distance between the base portions of two angle posts when folded along the same longitudinal edge being less than the distance between said end walls before folding so that a collapsed container fits within a non-collapsed container.

2. A collapsable container as claimed in claim 1, wherein each of said base portions includes an attaching member which connects each of said base portions by its respective joint to said bottom unit.

3. A collapsible container as claimed in claim 1, wherein each of said side doors which is adjacent to an angle post is pivotally connected thereto by a sleeve which surrounds the post.

4. A collapsible container as claimed in claim 1, wherein said end walls are balanced by spring means.

5. A collapsible container as claimed in claim 1, wherein said upper unit includes a roof cassette and further comprises means for locking said roof cassette to said posts.

6. A collapsible container as claimed in claim 5, further comprising means for lifting said roof cassette and for folding said posts, end walls and door packages against said bottom units, said means for lifting and folding being built into said collapsible containers.

* * * * *